US007554566B2

(12) United States Patent
Gila et al.

(10) Patent No.: US 7,554,566 B2
(45) Date of Patent: Jun. 30, 2009

(54) IMAGE DEVELOPMENT METHODS, HARD IMAGING DEVICES, AND IMAGE MEMBERS

(75) Inventors: Omer Gila, Cupertino, CA (US); Alfred I-Tsung Pan, Sunnyvale, CA (US); Michael H. Lee, San Jose, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 606 days.

(21) Appl. No.: 11/483,022

(22) Filed: Jul. 7, 2006

(65) Prior Publication Data

US 2008/0007609 A1 Jan. 10, 2008

(51) Int. Cl.
*G03G 15/06* (2006.01)
*G03G 13/06* (2006.01)

(52) U.S. Cl. ..... 347/120

(58) Field of Classification Search ..... 347/111, 347/112, 120, 125, 126; 399/222
See application file for complete search history.

(56) References Cited

U.S. PATENT DOCUMENTS 4,786,576 A 11/1988 Bujese
5,011,758 A 4/1991 Detig
5,346,796 A 9/1994 Almog
6,579,652 B1 6/2003 Detig
6,829,001 B2 12/2004 Yamakawa
6,899,998 B2 5/2005 Figov
2003/0013032 A1* 1/2003 Fields et al. ..... 430/122
2005/0176170 A1 8/2005 Detig
2009/0087765 A1* 4/2009 Kidokoro ..... 430/108.1

OTHER PUBLICATIONS

JP 57 054944 A; Canon KK; Image Forming Member For Electrophotography; Abstract; Apr. 1, 1982.
"HP Electrolink"; http://h30011.www3hp.com/Products/imaging/electrolink.html; Apr. 2005; 2 pp.
"HP Indigo Digital Printing"; Hewlett Packard Company; 2003; 8 pp.

* cited by examiner

*Primary Examiner*—Huan H Tran

(57) ABSTRACT

Image development methods, hard imaging devices, and image members are described. According to one embodiment, an image development method includes providing an image member comprising a surface having different portions of different electrical conductivities, wherein one of the portions defines an imaging pattern of an image, providing a development agent comprising a plurality of electrically charged image particles and a plurality of electrically charged charge directors over the image member, providing an electrical field proximate the image member having the development agent over the image member, and using the electrically charged charge directors and the electric field, directing the electrically charged image particles to the one of the portions of the surface of the image member to develop the image.

25 Claims, 2 Drawing Sheets

IMAGE DEVELOPMENT METHODS, HARD IMAGING DEVICES, AND IMAGE MEMBERS

FIELD OF THE DISCLOSURE

Aspects of the disclosure relate to image development methods, hard imaging devices, and image members.

BACKGROUND OF THE DISCLOSURE

Some hard imaging configurations include liquid and dry toner imaging systems. An exemplary electrophotographic (LEP) process may include a plurality of processing steps to form hard images using either liquid or dry toner. For example, the photoconductor may be electrically charged in preparation of receiving an image. A light source, such as a laser, may be used to discharge selective charged surface portions of the photoconductor which provides a latent image corresponding to an image to be formed. The latent image may be developed using liquid or dry toner and the developed image may be subsequently transferred by direct and/or intermediate transferring to media. Toner which remains upon the surface of the photoconductor after the transfer step may be cleaned by a cleaning station.

Arrangements which operate according to the above-described process are relatively complex, involve sophisticated and/or relatively expensive components, may suffer from registration problems during imaging and have associated speed limitations and/or a comparatively short lifetime of use.

At least some aspects of the disclosure are directed towards improved apparatus and methods of implementing hard imaging operations.

SUMMARY

According to some aspects of the disclosure, hard imaging methods, image development methods, hard imaging devices, and image members are described.

According to one aspect, an image development method comprises providing an image member comprising a surface having different portions of different electrical conductivities, wherein one of the portions defines an imaging pattern of an image, providing a development agent comprising a plurality of electrically charged image particles and a plurality of electrically charged charge directors over the image member, providing an electrical field proximate the image member having the development agent over the image member, and using the electrically charged charge directors and the electric field, directing the electrically charged image particles to the one of the portions of the surface of the image member to develop the image.

According to another aspect, a hard imaging device comprises an image member comprising an imaging pattern and a background area, wherein the imaging pattern corresponds to a hard version of an image to be formed upon media, a development assembly configured to provide a development agent comprising a plurality of electrically charged image particles and a plurality of electrically charged charge directors proximate the image member, and wherein the electrically charged image particles are directed to the imaging pattern of the image member to develop the image corresponding to the imaging pattern and the electrically charged charge directors are configured to screen the electrically charged image particles from the background area of the image member, and a transfer assembly configured to transfer the developed image to the media to form the hard version of the image.

Other embodiments and aspects are described as is apparent from the following discussion.

DETAILED DESCRIPTION

As discussed in further detail below, exemplary imaging systems and processes of at least some aspects of the disclosure utilize an image member which has a substantially fixed (e.g., non-erasable) image thereon to form a plurality of hard versions of the image upon sheets of media, such as paper. A liquid development (e.g., marking) agent may be used to develop the images and be transferred to the media in but one embodiment. Other aspects and embodiments are possible, some of which are described below.

Figure 1:
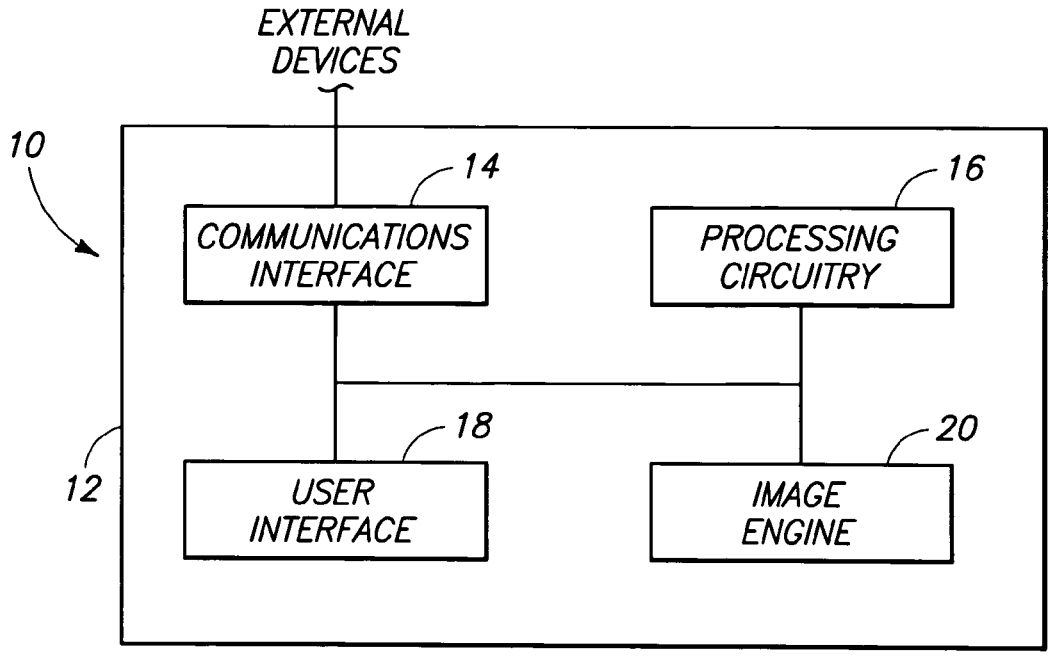
FIG. 1 is a functional block diagram of an exemplary hard imaging device according to one embodiment.

Referring to FIG. 1, an exemplary configuration of a hard imaging device 10 is shown according to one embodiment. Hard imaging device 10 of FIG. 1 includes a housing 12, a communications interface 14, processing circuitry 16, a user interface 18 and an image engine 20. Other configurations are possible, including more, less or alternative components.

Communications interface 14 is arranged to implement communications of hard imaging device 10 with respect to external devices (not shown). For example, communications interface 14 may be arranged to communicate information bi-directionally with respect to an external computing device, network or any device configured to implement communications. Communications interface 14 may be implemented as a network interface card (NIC), serial or parallel connection, USB port, Firewire interface, flash memory interface, floppy disk drive, or any other suitable arrangement for communicating with respect to hard imaging device 10. In one embodiment, commands to control operations of hard imaging device 10 and status of operations of hard imaging device 10 may be communicated using communications interface 14.

In one embodiment, processing circuitry 16 is arranged to receive and/or issue commands, process commands, control communications and/or control other desired operations of hard imaging device 10. Processing circuitry 16 may comprise circuitry configured to implement desired programming provided by appropriate media in at least one embodiment. For example, the processing circuitry 16 may be implemented as one or more of a processor and/or other structure configured to execute executable instructions including, for example, software and/or firmware instructions, and/or hardware circuitry. The processing circuitry may access executable instructions from processor usable media in one embodiment. Processor-usable media includes any article of manufacture or computer program product which can contain, store, or maintain programming, data and/or digital information for use by or in connection with an instruction execution system including processing circuitry in the exemplary embodiment. For example, exemplary processor-usable media may include any one of physical media such as electronic, magnetic, optical, electromagnetic, infrared or semiconductor media. Some more specific examples of processor-usable media include, but are not limited to, a portable magnetic computer diskette, such as a floppy diskette, zip disk, hard drive, random access memory, read only memory, flash memory, cache memory, and/or other configurations capable of storing programming, data, or other digital information.

Exemplary embodiments of processing circuitry 16 include hardware logic, PGA, FPGA, ASIC, state machines, and/or other structures alone or in combination with a processor. These examples of processing circuitry 16 are for illustration and other configurations are possible.

User interface 18 is configured to interact with a user including conveying data to a user (e.g., displaying data for observation by the user, audibly communicating data to a user, etc.) as well as receiving inputs from the user (e.g., tactile input, voice instruction, etc.). Accordingly, in one exemplary embodiment, the user interface may include a display (e.g., cathode ray tube, LCD, etc.) configured to depict visual information as well as a keyboard, mouse and/or other input device. Any other suitable apparatus for interacting with a user may also be utilized.

Image engine 20 is configured to form hard versions of one or more different images upon media. The images may be formed upon media, including plural sheets of paper, transparencies, labels or any other substrate or material capable of receiving developed images. Image engine 20 may utilize a development agent to develop images and be configured to transfer the developed images to the media.

Figure 2:
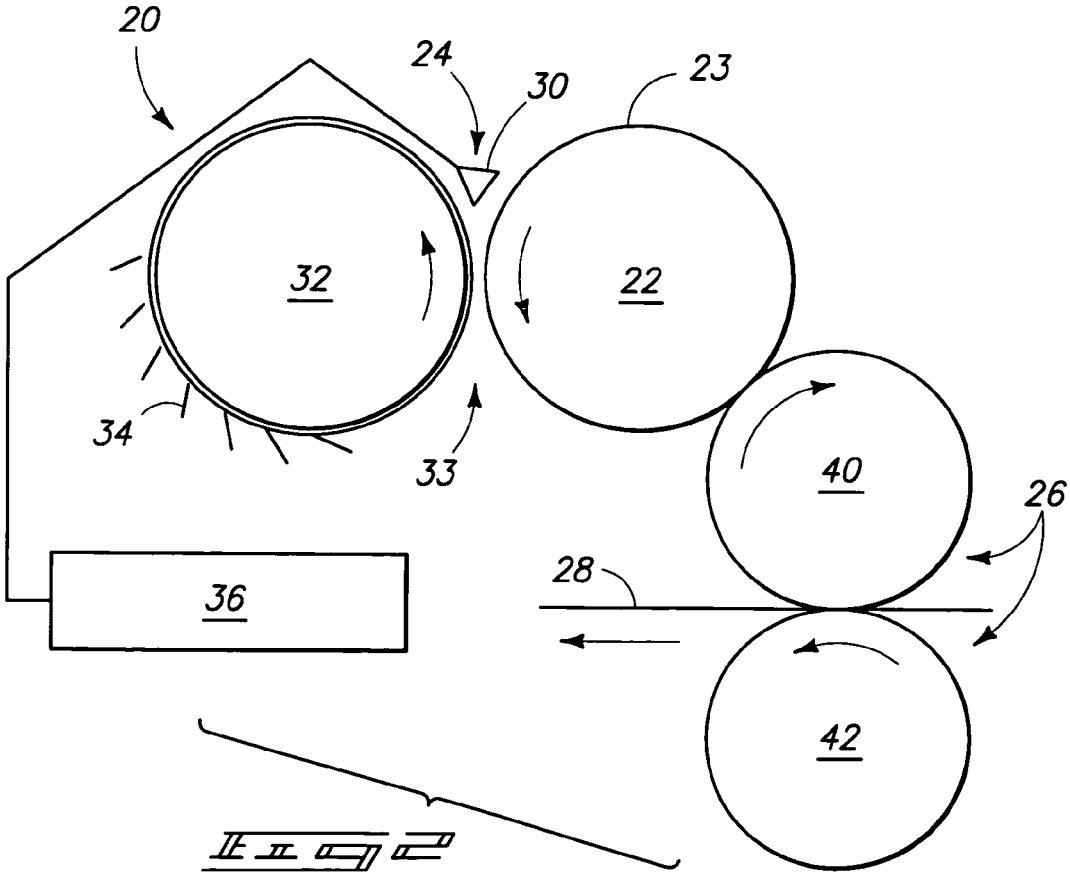
FIG. 2 is an illustrative representation of an exemplary image engine according to one embodiment.

Referring to FIG. 2, exemplary details of an image engine 20 are illustrated according to one embodiment. Image engine 20 includes an image member 22, a development assembly 24, and a transfer assembly 26 in one depicted embodiment. Other embodiments of image engine 20 are possible including more, less or alternative components.

Image member 22 is configured to receive a development agent to develop images. Image member 22 may be configured to rotate about an axis as shown during imaging operations. As is discussed below according to exemplary embodiments of FIGS. 3-5, image member 22 may include an imaging pattern (not shown in FIG. 2) upon an outer surface 23 which corresponds to the images to be developed and hard images to be formed. The imaging pattern may be substantially fixed to generate a plurality of hard versions of the same image upon media. In one embodiment, an individual image member 22 may be configured to generate the hard versions of the same image upon different sheets of media. In one aspect, a plurality of image members 22 may be used by a single hard imaging device 10 to form a plurality of different hard images upon media at a plurality of different moments in time. According to another aspect, image member 22 may be reconfigured to form different hard images upon media at different moments in time.

In another embodiment, image engine 20 may be configured to provide a plurality of different images or color separations. For example, a plurality of image members 22 may be provided along a paper path (not shown) and be configured to form the same or different images (i.e., plural imaging members 22 having the same or different imaging patterns) and/or color separations upon a sheet of media. In another possible implementation, a relatively large image member 22 may be used to provide multiple images and/or color separations upon one or more sheet of media (e.g., the outer surface 23 may have a circumference equal to approximately four times the length of a sheet of media and include the same or different imaging patterns to provide the respective same or different images and/or colors upon media). Other embodiments are possible.

Development assembly 24 is positioned adjacent to outer surface 23 of image member 22. Development assembly 24 is configured to provide a development agent proximate image member 22 (e.g., upon surface 23) to develop images upon surface 23 of image member 22. In the described embodiment, development assembly 24 is configured to provide the development agent comprising a liquid based marking agent to develop the images. Other configurations or development agents are possible.

For liquid applications, development assembly 24 may include one or more ink injectors 30, a development drum 32, a plurality of blades 34, and a development agent reservoir 36. Ink injectors 30 are configured to inject a liquid development agent upon surface 23 of image member 22 adjacent a nip 33 intermediate image member 22 and development drum 32. Development drum 32 is configured to rotate about a respective axis during imaging operations in a rotational direction opposite to image member 22 in the embodiment shown in FIG. 2. Development drum 32 may comprise a conductive drum in one arrangement configured to provide an electric field to assist with image development operations as is discussed in further detail below. Blades 34 are arranged to remove any excess development agent which remains upon development drum 32 and direct the development agent to reservoir 36. Reservoir 36 may store development agent for subsequent application to image member 22 by ink injectors 30.

An exemplary liquid development agent may include a plurality of electrically charged image particles and electrically charged charge directors within a liquid carrier (e.g., Isopar). One possible liquid development agent is Electrolnk® available from Hewlett-Packard Company as described in "HP Electrolink", http://h30011.www3hp.com/Products/imaging/electrolink.html, April 2005 and "HP Indigo Digital Printing", Hewlett Packard Company, 2003, the teachings of which are incorporated herein by reference. Other development agents may be used in other embodiments. Image particles may be used to form images upon media (e.g., paper) corresponding to image patterns described below, or conductive lines of circuits to be formed (circuits corresponding to image patterns) as described below. Exemplary electrically charged image particles include electrically charged ink particles having desired pigment(s), or electrically charged conductive particles (e.g., doped semiconductive material or metal particles encapsulated in an insulative resin) in illustrative embodiments. In exemplary implementations, the ink particles may be used to form images and the conductive particles may be used form conductive lines of electrical circuits as described in illustrative embodiments below.

It is desired in one embodiment to maintain a relatively constant concentration of image particles and charge directors within the liquid carrier (e.g., 2% concentration) in the reservoir 36 and additional image particles, charge directors and/or liquid carrier may be added to reservoir 36 during imaging operations for replacement during the formation of hard images.

Transfer assembly 26 is configured to transfer image particles of developed images upon image member 22 to media 28. In the illustrated embodiment, transfer assembly 26 includes an intermediate transfer member drum 40 and a impression drum 42 individually configured to rotate about respective axes as shown in FIG. 2. Sheets of media 28 are configured to pass between drums 40, 42 during imaging operations. Developed images are received upon intermediate transfer member drum 40 from image member 22 and are transferred to plural sheets of media 28 using drum 40 in one embodiment. In another embodiment, drum 40 may be eliminated and drum 22 may transfer developed images directly to media 28. Drum 40 may have a relatively soft blanket (e.g., rubber) to improve transfer in one embodiment. For example, image member 22 may include a soft conductive urethane layer (e.g., layer 52 below) coated with an insulative urethane layer (e.g., layer 54 below).

Figure 3:
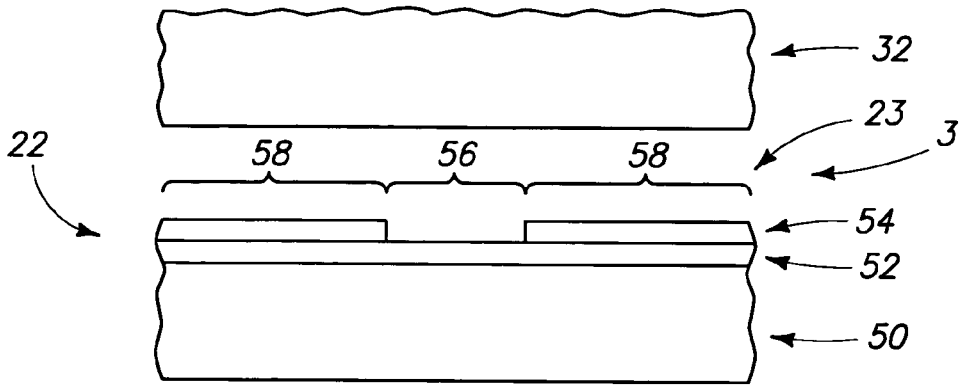
FIG. 3 is an illustrative representation of a development assembly and an image member according to one embodiment.

Referring to FIG. 3, exemplary details regarding development of images at nip 33 according to one embodiment are described. A surface of development drum 32 is illustrated adjacent surface 23 of image member 22. Image member 22 includes a support member 50 and a plurality of layers 52, 54 over support member 50 in the illustrated embodiment. Surface 23 of image member 22 provides an image pattern 56 corresponding to images to be formed upon media 28. In FIG. 3, only a portion (e.g., feature) of an image pattern 56 is shown. The illustrated portion or feature of image pattern 56 may correspond to text, graphics, or other portion of an image. Surface 23 also includes a background area 58. Background area 58 corresponds to blank portions which are not developed during development operations. The illustrated assembly including support member 50 and layers 52, 54 may be wrapped around an outer surface of a drum (not shown in FIG. 3) of image member 22 in one embodiment.

In one implementation, layers 52, 54 provide an image pattern 56 which may be used to generate a plurality of copies of the same image. The depicted layers 52, 54 may be removed along with support member 50 from the drum of image member 22 and another assembly including support member 50 and layers 52, 54 defining a different image pattern 56 may be wrapped around the drum to enable the formation of different images. In other embodiments, a plurality of different drums already providing different image patterns may be rotated into and out of imaging device 10 as necessary to form different images.

According to but one configuration, support member 50 may comprise an electrically insulative substrate, such as a polymer (e.g., Mylar), having a thickness of approximately 100μ. Layer 52 may comprise a conductive layer (e.g., copper or aluminum) and have a thickness of approximately <0.5μ and layer 54 may comprise a polymer (e.g., Kapton® available from Dupont) and have a thickness of approximately 2μ.

In one embodiment, layers 52, 54 have different electrical conductivities. For example, layer 52 may have a higher electrical conductivity than layer 54. In one embodiment, layer 52 may be considered to be substantially electrically conductive and layer 54 may be considered to be substantially electrically insulative. Accordingly, different portions of surface 23 may have different electrical conductivities corresponding to the image pattern 56 and background area 58 in one embodiment.

Other configurations of image members 22 are possible for providing image patterns 56. For example, in one embodiment, layers 50, 52 may be replaced by a conductive silicon substrate and layer 54 may be replaced by plural insulative layers including an insulative $SiO_2$ layer having a thickness of 100A upon the conductive silicon substrate and an insulative $Si_3N_4$ layer having a thickness of 2000A upon the $SiO_2$ layer. The $SiO_2$ layer may be a buffer layer to reduce tensile stress of the $Si_3N_4$ layer and to reduce cracking. Both of the layers may be etched to expose portions of the conductive silicon and which correspond to the image pattern 56.

Figure 4:
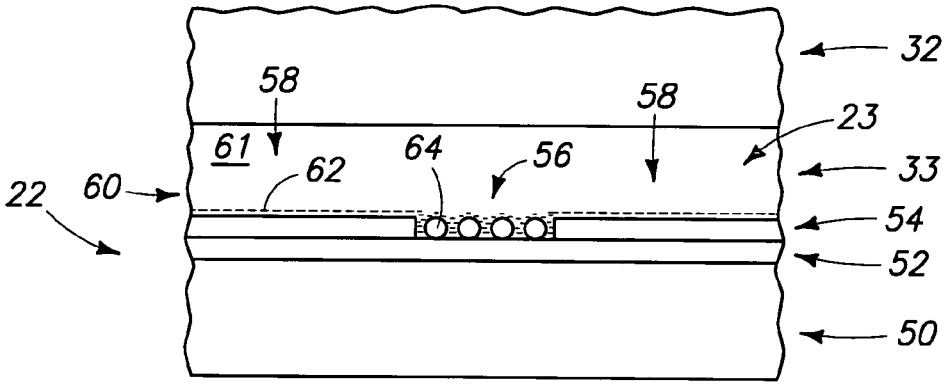
FIG. 4 is an illustrative representation of a development agent intermediate a development assembly and an image member according to one embodiment.

Referring to FIG. 4, additional details regarding development of images are described according to an exemplary embodiment. A liquid development agent 60 is illustrated intermediate surface 23 of image member 22 and a surface development drum 32. The liquid marking agent 60 includes a liquid medium or carrier 61 (e.g., Isopar oil), a plurality of charge directors 62, and a plurality of image particles 64. In the depicted embodiment, only negatively charged charge directors 62 are shown. Positively charged charge directors may also be present (e.g., 50% positive and 50% negative charge directors) and attracted to drum 32 and not impact development operations in one embodiment.

As shown in FIG. 4, during exemplary development operations according to one embodiment, the image particles 64 are directed to the image pattern 56 to develop the images. As mentioned above, the illustrated charge directors 62 and image particles 64 may be individually electrically charged. An electrical field may be utilized in conjunction with negatively charged charge directors 62 to direct electrically charged image particles 64 to the image pattern 56. A development time of approximately 4 msec is provided in one embodiment.

According to one specific embodiment, development drum 32 may be negatively biased with respect to layer 52 which may be referred to as a ground layer in one embodiment. An electrical field of approximately 2V/μ is provided in one embodiment by biasing development drum 32 at approximately −300V, grounding layer 52 and having a spacing at nip 33 between a surface of development drum 32 and surface 23 of image member 22 of approximately 150μ. The electrical field may be provided across substantially an entirety of the surface 23 of image member 22 at nip 33 including the image pattern 56 and background area 58. The electrical field may be considered to be provided from external of the image member 22 in an arrangement wherein development drum 32 is negatively biased and layer 52 is grounded. Appropriate electrical fields may be provided by other biasing or using other components in any suitable fashion in other embodiments.

The generated electrical field may be referred to as a development field which may operate to push or direct both negatively charged charge directors 62 and negatively charged image particles 64 towards surface 23 of image member 22. Charge directors 62 have increased mobility relative to particles 64 and a substantial majority of them arrive at surface 23 before image particles 64. At background areas 58, surface 23 is substantially electrically insulative and charge directors 62 screen the electrical field and screen the image particles 64 from being developed at background areas 58. However, at locations of image pattern 56, the surface 23 is substantially electrically conductive leading the charge directors 62 to give up their excess electrons thereby becoming neutral. Image particles 64 continue moving only towards image pattern 56 of surface 23. Development still occurs even if the charge directors 62 do not give up their respective charges inasmuch as they have insufficient screening effect due to their close distance to layer 52 compared with the spacing of charge directors 62 against layer 54 relative to layer 52 operating to screen the electrical field.

In one embodiment, image particles 64 are larger than charge directors 62 (e.g., approximately 1000 nm compared with approximately 1 nm) and the image particles 64 stick to image pattern 56 without losing their respective charges resulting in development of images corresponding to the image pattern 56 while leaving the background areas 58 substantially undeveloped. Thereafter, the developed image corresponding to the image pattern 56 may be transferred via transfer assembly 26 to media 28.

The discussion now proceeds with respect to one exemplary method of forming the image pattern 56 and background areas 58 of image member 22. In one possible implementation, the support member 50 may be coated with layers 52, 54. An excimer laser may be programmed with the image pattern 56 to be formed and may be aligned with the support member 50 and layers 52, 54 thereover to ablate away portions of layer 54 corresponding to the image pattern 56 to expose respective portions of the layer 52 providing the image pattern 56.

Figure 5:
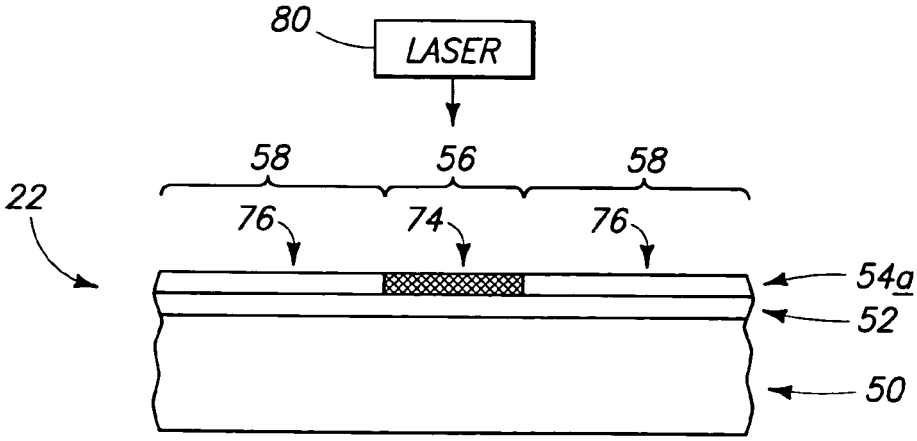
FIG. 5 is an illustrative representation depicting exemplary formation of an image member according to one embodiment.

Referring to FIG. 5, another exemplary method of forming image pattern 56 corresponding to another embodiment is shown. For example, the support member 50 may be provided with layer 52 thereover. Layer 54*a* may comprise semiconductive material and may be deposited over layer 52 as shown in FIG. 5. In one embodiment, layer 54*a* comprises amorphous silicon and plasma enhanced chemical vapor deposition (PECVD) may be used to form the layer 54*a* in one possible process. As deposited, amorphous silicon has a relatively high electrical resistance due to random networks of silicon sufficient to be considered substantially electrically non-conductive or insulative. Portions of layer 54*a* may be converted to crystallized silicon which may be considered to be substantially electrically conductive. In one embodiment, amorphous silicon may have a sheet resistance of 14 kOhm/sq compared with several Ohm/sq for crystallized silicon. An excimer laser 80 may be utilized to convert portions of the amorphous silicon to crystalline silicon corresponding to the image pattern 56 in one embodiment. In one embodiment, after deposition of the amorphous silicon, the image patterns 56 may be formed in a web configuration.

An advantage of using the exemplary process of FIG. 5 is the ability to generate random patterns on demand corresponding to different image patterns 56 to be formed. Further, the utilization of a relatively thin amorphous silicon layer enables very fine geometry to be formed exceeding a capability of conventional electrophotography. For example, it is expected that a feature size of approximately 5 microns is attainable for image pattern 56 using the exemplary described process.

In addition to the examples discussed herein, other methods may utilized to form image pattern 56 and background area 58. For example, insulating liquid phase polymers may be deposited upon a conductive layer by using a random addressable device (inkjet) or by contact means such as gravure or imprint. The polymers may be exposed to ultraviolet light or cured to form the background area 58 and defining the image pattern 56 therebelow. Other methods may be used to form the desired image pattern 56 in other embodiments.

As mentioned above according to at least one embodiment, image pattern 56 may be substantially fixed for a respective image member 22. In one configuration of hard imaging device 10, a plurality of image members 22 may be provided having respective different image patterns 56 usable to generate hard versions of different images upon media 28. Accordingly, in one implementation, a first image member 22 having a first image pattern 56 may be used to generate one or more hard images for a first run of forming images upon media and thereafter the first image member 22 may be replaced with a second image member 22 having a different image pattern 56 and processing may be resumed as described above to generate one or more hard images for a second run of forming different images upon media.

Accordingly, in one embodiment, the image patterns 56 may be considered to be permanent for the respective image members 22 (e.g., unless the image patterns 56 are subsequently removed and replaced, reformed or defined differently upon the respective image members 22). In other words, image patterns 56 which may be referred to as permanent according to but one embodiment may not be readily changed upon respective image members 22 as in electrophotographic printing using a photoconductor.

An experiment demonstrated that image patterns may be successfully generated using ElectroInk® development agent between two conductive surfaces (Indium Tin Oxide) of opposing plates (e.g., corresponding to development drum 32 and layer 52) spaced 4 mm apart, an approximately 1 micron layer 54, and with an associated electrical field of 5000V. The exemplary process illustrated an ability of making an image pattern in the shape of a bar corresponding to an exposed surface of one of the plates while the remainder of the plate was covered by a 35μ layer of substantially electrically insulative material and substantially undeveloped.

As mentioned above, some embodiments of the disclosure are directed towards generating electrical circuits using image engine 20. The image particles 64 may be electrically charged and comprise conductive doped semiconductive particles (e.g., doped p type), or conductive metal particles (e.g., 1 micron metal particles or flakes which are encapsulated with an insulative resin to permit charging). A circuit is provided including conductive lines formed by the conductive particles by development of the image pattern 56. If encapsulated metal conductive particles are used, the formed lines may be heated after development to remove the resin in one embodiment.

Advantages of some of the disclosed embodiments include imaging without the use of a writing head or laser. Accordingly, the process may be more straightforward and cost effective compared with electrophotography solutions. Further, at least some embodiments may provide image engines 20 which are robust and do not have the limitations typically associated with other arrangements with respect to writing head dot size, speed, or width. Registration problems involved with electrophotography systems may be reduced or avoided and charging stations (e.g., Scorotrons) may be eliminated further simplifying and reducing the cost while increasing the robustness of the image engine 20 and reducing limitations of speed of the image engine 20. In addition, the life time of the image member 56 may also be increased compared with some other systems.

The protection sought is not to be limited to the disclosed embodiments, which are given by way of example only, but instead is to be limited only by the scope of the appended claims.

What is claimed is:

1. An image development method comprising:

providing an image member comprising a surface having different portions of different electrical conductivities, wherein one of the portions defines an imaging pattern of an image;

providing a development agent comprising a plurality of electrically charged image particles and a plurality of electrically charged charge directors over the image member;

providing an electrical field proximate the image member having the development agent over the image member; and using the electrically charged charge directors and the electric field, directing the electrically charged image particles to the one of the portions of the surface of the image member to develop the image.

2. The method of claim 1 wherein the directing comprises screening the electrically charged image particles from an other of the portions of the image member using the electrically charged charge directors.

3. The method of claim 2 wherein the one of the portions has an increased electrical conductivity compared with the other of the portions.

4. The method of claim 1 wherein a polarity of a voltage external of the image member to provide the electrical field is the same as a polarity of the electrically charged image particles and a polarity of the electrically charged charge directors.

5. The method of claim 1 wherein the providing the development agent comprises providing the development agent comprising a liquid medium comprising the electrically charged image particles and charge directors.

6. The method of claim 1 wherein the imaging pattern is substantially fixed to provide the same hard versions of the image for a plurality of sheets of media.

7. The method of claim 1 wherein the providing the development agent comprises providing the image particles comprising a plurality of electrically charged electrically conductive particles, and the directing develops the image comprising a plurality of conductive lines of an electrical circuit.

8. A hard imaging device comprising:

an image member comprising an imaging pattern and a background area, wherein the imaging pattern corresponds to a hard version of an image to be formed upon media;

a development assembly configured to provide a development agent comprising a plurality of electrically charged image particles and a plurality of electrically charged charge directors proximate the image member, and wherein the electrically charged image particles are directed to the imaging pattern of the image member to develop the image corresponding to the imaging pattern and the electrically charged charge directors are configured to screen the electrically charged image particles from the background area of the image member; and a transfer assembly configured to transfer the developed image to the media to form the hard version of the image.

9. The device of claim 8 wherein the development assembly is configured to direct the electrically charged image particles to the imaging pattern of the image member.

10. The device of claim 9 wherein the development assembly is configured to provide an electrical field to direct the electrically charged image particles to the imaging pattern.

11. The device of claim 8 wherein the development assembly is configured to provide the development agent comprising a liquid medium comprising the electrically charged image particles and charge directors.

12. The device of claim 8 wherein the imaging pattern and the background area comprise different electrical conductivities.

13. The device of claim 12 wherein imaging pattern has an electrical conductivity greater than the background area.

14. The device of claim 12 wherein the imaging pattern is substantially electrically conductive and the background area is substantially electrically insulative.

15. The device of claim 8 wherein the transfer assembly is configured to transfer the developed image to the media comprising paper.

16. The device of claim 8 wherein the transfer assembly is configured to transfer a plurality of the developed images to a plurality of sheets of paper, and wherein the imaging pattern and background area are substantially fixed during formation and transfer of the developed images to the sheets of paper.

17. The device of claim 8 wherein the image member comprises a first image member, and further comprising a second image member comprising another imaging pattern and another background area different than the imaging pattern and background area of the first image member, and wherein the second image member is configured to replace the first image member.

18. The device of claim 8 wherein the imaging pattern is substantially fixed to provide the same hard versions of the image for a plurality of sheets of the media.

19. An image member of a hard imaging device comprising:

an imaging pattern having a first electrical conductivity and wherein the imaging pattern corresponds to a plurality of hard versions of an image to be formed upon a plurality of sheets of media at a plurality of different moments in time;

a background area over the imaging pattern and wherein the background area comprises a second electrical conductivity different than the first electrical conductivity; and wherein the imaging pattern is substantially fixed to form the hard versions of the image comprising the same image upon the sheets of media.

20. The member of claim 19 further comprising an electrically conductive layer configured to provide the imaging pattern.

21. The member of claim 20 further comprising an electrically insulative layer covering one portion of the electrically conductive layer corresponding to the background area and leaving an other portion of the electrically conductive layer outwardly exposed corresponding to the imaging pattern.

22. The member of claim 19 wherein the imaging pattern is configured to attract a plurality of electrically charged image particles to develop the hard versions of the image to be formed upon the sheets of media.

23. The member of claim 19 wherein the imaging pattern has an increased electrical conductivity compared with the background area.

24. The device of claim 19 wherein the imaging pattern comprises substantially crystallized semiconductive material and the background area comprises substantially amorphous semiconductive material.

25. The device of claim 19 wherein the imaging pattern is substantially permanent.

* * * * *